US007845779B2

(12) United States Patent
Nip

(10) Patent No.: US 7,845,779 B2
(45) Date of Patent: Dec. 7, 2010

(54) INK CARTRIDGE WITH A HANDLE FOR INKJET PRINTERS

(75) Inventor: Shui Kuen Nip, Hong Kong (HK)

(73) Assignee: Powerful Way Limited, North Point (HK)

( * ) Notice: Subject to any disclaimer, the term of this patent is extended or adjusted under 35 U.S.C. 154(b) by 641 days.

(21) Appl. No.: 11/781,291

(22) Filed: Jul. 23, 2007

(65) Prior Publication Data

US 2008/0024571 A1 Jan. 31, 2008

(30) Foreign Application Priority Data

Jul. 25, 2006 (CN) ..... 2006 2 0062024 U

(51) Int. Cl.
*B41J 2/175* (2006.01)

(52) U.S. Cl. ..... 347/86; 347/49; 347/84; 347/85; 347/87

(58) Field of Classification Search ..... 347/49, 347/84, 85, 86, 87
See application file for complete search history.

(56) References Cited

U.S. PATENT DOCUMENTS 6,481,829 B1 * 11/2002 Bailey et al. ..... 347/49
6,789,876 B2 * 9/2004 Barclay et al. ..... 347/37
7,052,121 B2 * 5/2006 Yamada ..... 347/86
7,121,644 B2 * 10/2006 Ueda et al. ..... 347/29
7,275,809 B2 * 10/2007 Uwagaki et al. ..... 347/49
2002/0015077 A1 * 2/2002 Eckard et al. ..... 347/50
2002/0163566 A1 * 11/2002 Jang et al. ..... 347/86
2003/0174181 A1 * 9/2003 Nishioka et al. ..... 347/7
2004/0001129 A1 * 1/2004 Lim ..... 347/86
2004/0017448 A1 * 1/2004 Murakami et al. ..... 347/86
2004/0196333 A1 * 10/2004 Yoshiyama et al. ..... 347/49
2005/0185035 A1 * 8/2005 Takei ..... 347/86
2005/0275700 A1 * 12/2005 Buchanan et al. ..... 347/86
2006/0209145 A1 * 9/2006 Yazawa et al. ..... 347/86

* cited by examiner

*Primary Examiner*—Ryan Lepisto
(74) *Attorney, Agent, or Firm*—Rabin & Berdo, P.C.

(57) ABSTRACT

The present invention relates to an ink cartridge with a handle for inkjet printers. The ink cartridge includes a cartridge housing (1) having hook-avoidance grooves (2) with a proper depth and corresponding to the pulling hooks (11) of the locking cover (10) of the printhead, and a handle (3) disposed on an upper surface of the ink cartridge body (1). The structure of the handle (3) is in a form of double-folding type. Alternatively, the handle can also be in a form of single straight flip-down type construction. Because of the handle structure, the present invention is not only able to relieve the installation and removal of the ink cartridge from excessive reliance on the locking cover of the print head, but also to make the ink cartridge installation and removal more natural, positive and user controlled.

23 Claims, 1 Drawing Sheet

INK CARTRIDGE WITH A HANDLE FOR INKJET PRINTERS

FIELD OF THE INVENTION

The present invention relates to an ink cartridge with a handle for use in an inkjet printer. More particularly, although not exclusively, the present invention relates to the structure and a method for the installation and removal of an ink cartridge inside the printhead of an inkjet printer.

BACKGROUND OF THE INVENTION

Some of the present inkjet printers in the market require the ink cartridges to be installed and removed by operating the locking covers of the printhead. The locking covers are pivotably mounted to the printhead and include at least one pulling hook. A supporting tab which matches with the pulling hook has to be provided on the front end outside surface of each ink cartridge so that each supporting tab is engaged by a pulling hook when the ink cartridge is being removed. Otherwise, the removal of the ink cartridge will be very inconvenient and sometimes even impossible. When the locking cover is in an open position, the ink cartridge cannot be easily installed in the printhead by pressing directly on the upper surface of the ink cartridge because the supporting tab is engaged with the pulling hook of the locking cover. Instead, to install the ink cartridge the locking cover must be pivoted to the closed position, which in turn presses a leaf spring which is disposed on bottom surface of the locking cover onto the upper surface of the ink cartridge body. Therefore, for an ink cartridge having these exterior installation structures, not only does the installation of the ink cartridge require the locking cover to provide the functions of supporting the ink cartridge and pressing it into proper installed position, but also the removal of the ink cartridge requires the locking cover to pull or lever the ink cartridge out of the printhead as a result of the engagement between the pulling hook and the supporting tab. Furthermore, after the ink cartridge is installed in place, the locking cover is required to protect the ink cartridge against dust and from being accidentally dislodged from the printhead. The installation, removal and use of this type of ink cartridge therefore depends excessively on the functions of the locking cover.

The leaf spring of the locking cover is held in a compression mode for long periods of time. This means that the leaf spring is easily deformed and may even fail due to fatigue. If the leaf spring is deformed or fails then the ink cartridge may not be installed in a proper position in the printhead and the ink cartridge may not be recognized by the printer. The ink cartridge may also provide poor print quality. In addition, the pulling hook of the locking cover is easily deformed or broken making it difficult to remove the ink cartridge.

SUMMARY OF THE INVENTION

An object of the present invention is to provide an ink cartridge without any supporting tab structures which are conventionally required for the normal installation and removal of an ink cartridge to a printhead. This provides an improved method of installing and removing the ink cartridge in the printhead and reduces the reliance on the locking cover of the printhead during the ink cartridge installation and removal processes.

It is a further object of the present invention to allow the user to positively press the ink cartridge in place to ensure proper installation of the ink cartridge.

It is also a further object of the present invention to allow the user to remove the ink cartridge from the printhead without the need for any help from the pulling hook of the locking cover.

The above-mentioned objects of the present invention are provided by an ink cartridge for use with inkjet printers having a printhead that includes a pivotable locking cover with a pulling hook, the ink cartridge comprising a cartridge body having at least one groove through which the pulling hook of the locking cover may pass freely when the ink cartridge is installed in the printhead of the inkjet printer, and a handle disposed on an upper surface of the cartridge body.

The handle is preferably made of thermoplastic material with high resilience properties and can be in the form of a double-folding structure comprising a left folding handle portion, a right folding handle portion and a connecting portion disposed at the upper ends of the two folding handle portions.

The left folding handle portion and the right folding handle portion are preferably symmetrical to each other and include a plurality of straight arm segments. Adjacent straight arm segments of the left folding handle portion and the right folding handle portion, respectively, are preferably joined together by connecting arm segments.

Lower straight arm segments of the left folding handle portion and the right folding handle portion are preferably symmetrically and integrally attached to the upper surface of the cartridge body. Upper straight arm segments of the left folding handle portion and the right folding handle portion are preferably symmetrically and integrally connected with the connecting portion.

The connection portion is preferably thicker in cross-section than the left folding handle portion and the right folding handle portion.

The handle may also have a flip-down structure. In this case, the handle preferably has a thinner section to form a "V"-shaped groove disposed at the base thereof, serrations in a form of raised ridges disposed on a middle portion thereof, and a head portion which has a substantially semi-circular profile and a substantially circular cross-section.

The present invention is able to relieve the installation and removal of the ink cartridge from excessive reliance on the locking cover. This enables the locking cover to provide only the functions of dust prevention and dislodgement prevention for the ink cartridge. It also enables the ink cartridge to be installed with directness, independency and freedom by the user. Therefore, the ink cartridge installation becomes more user controlled thus ensuring that the ink cartridge can be properly recognized by the printer after installation and reliably avoids poor print quality problems caused by improper installation of the ink cartridge.

BRIEF DESCRIPTION OF THE DRAWINGS

Detailed structures of the prevent invention are shown in the following embodiments and drawings.

In these figures, the labels and their corresponding part names are:

"1"—cartridge body
"2" hook-avoidance groove
"3"—handle
"4"—left folding handle portion
"5"—right folding handle portion
"6"—connecting portion
"7"—"V"-shaped groove
"8"—serration
"9"—round head
"10"—locking cover of the printhead
"11"—pulling hook of the locking cover
"12"—leaf spring of the locking cover
"13"—printhead of an inkjet printer

DETAILED DESCRIPTION OF THE PREFERRED EMBODIMENTS

Figure 1:
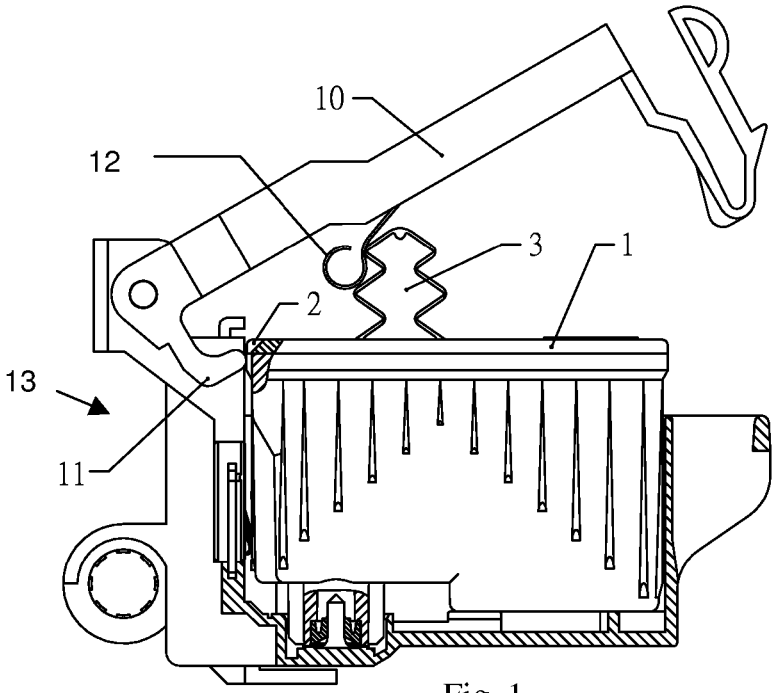
FIG. 1 is an assembled view of an ink cartridge with a double-folding handle installed in the frame of the print-head of an inkjet printer.
Figure 3:
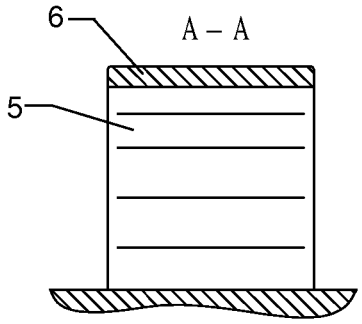
FIG. 3 is a cross-sectional view taken along the line A-A of FIG. 2.

As shown in FIG. 1 and FIG. 3, a pair of hook-avoidance grooves 2 with appropriate depth and each corresponding to a pulling hook 11 of the locking cover 10 of a printhead (generally designated 13) are disposed on a front side surface of the ink cartridge body 1. A handle 3 which is made of resilient thermoplastic material is disposed on a top surface of the ink cartridge body 1. The handle 3 has a double-folding structure comprising a left folding handle portion 4, a right folding handle portion 5 and a connecting portion 6 at the upper ends of the two folding handle portions 4, 5. The left folding handle portion 4 and the right folding handle portion 5, which are symmetrical to each other, have lower straight arm segments and that are symmetrically and integrally attached to the upper surface of the ink cartridge body 1. Upper straight arm segments of the left folding handle portion 4 and the right folding handle portion 5 are symmetrically and integrally connected with the connecting portion 6 which is thicker in cross-section than the upper straight arm sections. The left folding handle portion 4 and the right folding portion 5 also have a plurality intermediate straight arm segments that are arranged between the upper straight arm segments and the lower straight arm segments. Adjacent straight arm segments of the left folding handle portion 4 and the right folding handle portion 5 are connected together by arcuate connecting arm segments. Compared to the straight arm segments, the connecting arm segments have smaller thickness, lower strength and higher elasticity. The connecting arm segments therefore act as flexible joints or hinges about which the adjacent straight arm segments can be turned or pivoted such that the whole handle 3 can be straightened or folded in a vertical direction, like the bellow of an accordion.

There is no special external structure (such as supporting tabs) located on the ink cartridge body to be engaged by the pulling hooks 11 of the locking cover 10. Instead, the ink cartridge includes hook avoidance-grooves 2 that are specifically designed to avoid engagement between the ink cartridge and the locking cover 10 when the locking cover is pivoted between the open and closed positions. Therefore, the ink cartridge cannot be pulled or levered out of the printhead 13 by the pivoting pulling hooks 11 of the locking cover 10 but can only be pulled out and removed by the user by pulling the handle 3 in an upward direction.

Figure 2:
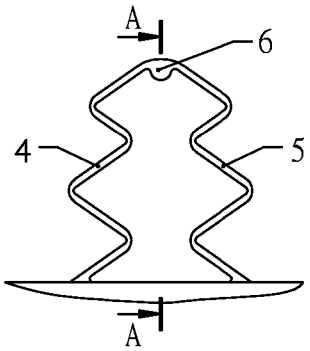
FIG. 2 is an enlarged view of the handle "3" of FIG. 1.

When the user pivots the locking cover 10 upwards to move it to the open position, the pressure originally exerted by the leaf spring 12 on the handle 3 disappears and the handle can then recover to its initial uncompressed condition due to the resilience of the connecting arm segments of the left and right folding handle portions 4, 5. When the user presses simultaneously on the two outside surfaces of the left and the right folding handle portions 4, 5, the intermediate straight arm segments and the upper straight arm segments of the left and right handle portions 4, 5 pivotally turn about the connecting arm segments, while the connecting arm segments themselves, acting as hinges, simultaneously generate linear upward movements, thereby causing the straight arm segments of the left folding handle portion 4, together with all its connecting arm segments to be pressed against the corresponding symmetrical straight arm segments and the connecting arm segments of the right folding handle portion 5, to form a straight handle extending in an upward direction. At this moment, the overall thickness of the handle 3 in the right-to-left direction as shown in FIG. 2 is equal to the sum of the thicknesses of two straight arm segments of the left and the right folding handle portions 4, 5. The cross-sectional dimension of the connecting portion 6 is larger than the sum of the two straight arm segments so that the handle 3 gradually forms a pulling knob during the process of pulling and stretching. This allows the user to apply a more secure finger grip and more stable pull on the handle and facilitates the removal of the ink cartridge from the printhead.

When installing the ink cartridge to the printer, in the process when the user pivots the locking cover 10 of the printhead downward and closes and locks the locking cover to the frame of the printhead, the leaf spring 12 which is disposed on the bottom surface of the locking cover comes into contact with the connecting portion 6 and the straight arm segments of the two ends thereof and produces downward pressure. The straight arm segments of the left and the right folding handle portions 4, 5 turning pivotally about their adjacent connecting segments together with the connecting arm segments acting as hinges, create simultaneously downwards movements, so that the symmetrical straight arm segments together with the connecting arm segments of the left and the right folding handle portions 4, 5 are pressed to contact with each other in a top-to-bottom direction, so as to form a folded handle shrinking downwards, thereby avoiding interference with the leaf spring 12 and all other parts disposed on the bottom surface of the locking cover 10 of the printhead.

Because the ink cartridge is not supported or engaged by the pulling hooks 11 of the locking cover 10, it can either be installed properly in place by directly pressing on the upper surface before the locking cover 10 is closed, then pivoting the locking cover downwards to the locking position just like installing an ink cartridge without a handle, or alternatively by pressing it properly in place by closing the locking cover 10, without any direct contact with the ink cartridge, just like installing an ink cartridge without a handle.

Figure 4:
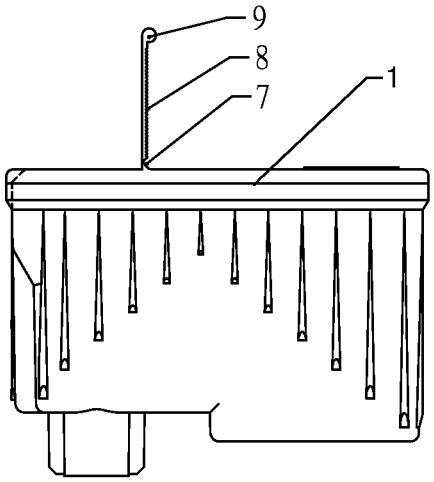
FIG. 4 is a front view of an ink cartridge with a single straight-fold-down handle.
Figure 5:
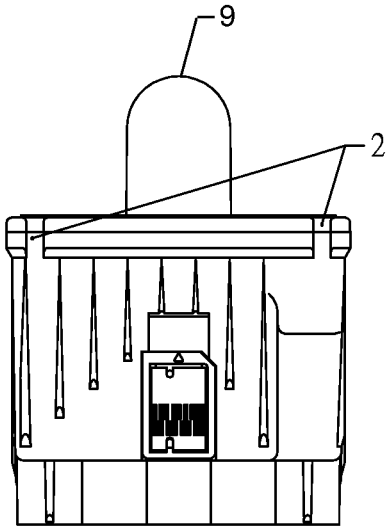
FIG. 5 is a left view of the ink cartridge of FIG. 4.

The handle can also be designed as shown in FIGS. 4 and 5, as a single straight handle with a flip-down construction comprising of a "V"-shaped groove 7, serrations 8 in a form of raised ridges and a semi-circular head 9. The handle base which is integrally connected to the top surface of the ink cartridge is in a form of "V" shaped groove 7, therein the thickness is smaller and so the elasticity is higher, thereby allowing the handle to be elastically and uni-directionally turned pivotally about the groove, flipped down to the right side and laid flat on the upper surface of the ink cartridge. This reduces the actual overall size of the ink cartridge and allows the locking cover 10 of the printhead to be properly closed and locked without any interference. The serrations 8 in a form of raised ridges having triangular cross-sections are disposed on the central part of one side of the handle so as to increase the friction with the user's fingers. This improves the stability of handling by human fingers and reduces the possibility of fingers slipping off the handle when the ink cartridge is installed or removed by the user. As shown in FIG. 5, the top part of the handle has a semi-circular profile of which the cross-section is a round head 9 as shown in FIG. 4. A surface of the round head 9 is significantly higher than that of the triangular cross-sectional serrations 8 below the round head 9 to form an "L"-shaped barb on the handle such that the ease and stability of being handled by fingers are further improved. The cross-section of the barb is designed to have no sharp edge or corners all around the surface so that it can be comfortably handled by human fingers during ink cartridge installation and removal.

The invention claimed is:

1. An ink cartridge for use with inkjet printers having a printhead that includes a pivotable locking cover with a pulling hook, the locking cover being pivoted between an open position and a closed position, the ink cartridge comprising:

a cartridge body having at least one groove through which the pulling hook of the locking cover may pass freely when the ink cartridge is installed in the printhead; and a handle integrally disposed on an upper surface of the cartridge body, the handle being elastically laid flat on the upper surface of the cartridge body when the locking cover is in the closed position.

2. An ink cartridge according to claim 1, wherein the handle has a folding structure.

3. An ink cartridge according to claim 2, wherein the handle includes a left folding handle portion, a right folding handle portion and a connecting portion disposed at upper ends of the two said folding handle portions.

4. An ink cartridge according to claim 3, wherein the left folding handle portion and the right folding handle portion are symmetrical to each other and include a plurality of straight arm segments.

5. An ink cartridge according to claim 4, wherein adjacent straight arm segments of the left folding handle portion and the right folding handle portion, respectively, are joined together by connecting arm segments.

6. An ink cartridge according to claim 5, wherein lower straight arm segments of the left folding handle portion and the right folding handle portion are symmetrically and integrally attached to the upper surface of the cartridge body.

7. An ink cartridge according to claim 6, wherein upper straight arm segments of the left folding handle portion and the right folding handle portion are symmetrically and integrally connected with the connecting portion.

8. An ink cartridge according to claim 7, wherein the connection portion is thicker in cross-section than the left folding handle portion and the right folding handle portion.

9. An ink cartridge according to claim 6, wherein the connection portion is thicker in cross-section than the left folding handle portion and the right folding handle portion.

10. An ink cartridge according to claim 5, wherein upper straight arm segments of the left folding handle portion and the right folding handle portion are symmetrically and integrally connected with the connecting portion.

11. An ink cartridge according to claim 10, wherein the connection portion is thicker in cross-section than the left folding handle portion and the right folding handle portion.

12. An ink cartridge according to claim 5, wherein the connection portion is thicker in cross-section than the left folding handle portion and the right folding handle portion.

13. An ink cartridge according to claim 4, wherein lower straight arm segments of the left folding handle portion and the right folding handle portion are symmetrically and integrally attached to the upper surface of the cartridge body.

14. An ink cartridge according to claim 13, wherein upper straight arm segments of the left folding handle portion and the right folding handle portion are symmetrically and integrally connected with the connecting portion.

15. An ink cartridge according to claim 14, wherein the connection portion is thicker in cross-section than the left folding handle portion and the right folding handle portion.

16. An ink cartridge according to claim 13, wherein the connection portion is thicker in cross-section than the left folding handle portion and the right folding handle portion.

17. An ink cartridge according to claim 4, wherein upper straight arm segments of the left folding handle portion and the right folding handle portion are symmetrically and integrally connected with the connecting portion.

18. An ink cartridge according to claim 17, wherein the connection portion is thicker in cross-section than the left folding handle portion and the right folding handle portion.

19. An ink cartridge according to claim 4, wherein the connection portion is thicker in cross-section than the left folding handle portion and the right folding handle portion.

20. An ink cartridge according to claim 2, wherein the handle is initially in an unfolded condition when the locking cover is in the open position, the handle is being folded when the locking cover is pivoted from the open position to the closed position, and the handle recovers to the initial unfolded condition when the locking cover is pivoted from the closed position to the open position.

21. An ink cartridge according to claim 20, wherein the handle includes a left folding handle portion and a right folding handle portion, which are joined by resilient connecting arm segments, and the handle recovers to the initial unfolded condition due to the resilience of the connecting arm segments when the locking cover is pivoted from the closed position to the open position.

22. An ink cartridge according to claim 1, wherein the handle has a flip-down structure.

23. An ink cartridge according to claim 22, wherein the handle has a thinner section to form a "V"-shaped groove disposed at a base of the handle, serrations in a form of raised ridges disposed on a middle portion thereof, and a head portion which has a substantially semi-circular profile and a substantially circular cross-section.

* * * * *